US007147133B2

(12) United States Patent
Brouwer et al.

(10) Patent No.: US 7,147,133 B2
(45) Date of Patent: Dec. 12, 2006

(54) FOAM FORMING UNIT

(75) Inventors: Markus Franciskus Brouwer, Heesch (NL); Johannes Hubertus Jozef Maria Kelders, Drunen (NL)

(73) Assignee: R+D Injector AG, Baar (CH)

( * ) Notice: Subject to any disclaimer, the term of this patent is extended or adjusted under 35 U.S.C. 154(b) by 36 days.

(21) Appl. No.: 10/432,479

(22) PCT Filed: Nov. 23, 2001

(86) PCT No.: PCT/NL01/00852

§ 371 (c)(1),
(2), (4) Date: Nov. 6, 2003

(87) PCT Pub. No.: WO02/42005

PCT Pub. Date: May 30, 2002

(65) Prior Publication Data

US 2004/0069807 A1 Apr. 15, 2004

(30) Foreign Application Priority Data

Nov. 23, 2000 (NL) ..... 1016694

(51) Int. Cl.
*B67D 5/58* (2006.01)
*G01F 11/00* (2006.01)

(52) U.S. Cl. ..... 222/145.5; 222/189.11; 222/190; 222/321.7

(58) Field of Classification Search ..... 222/145.5, 222/145.6, 189.09, 189.11, 190, 321.7, 321.9
See application file for complete search history.

(56) References Cited

U.S. PATENT DOCUMENTS 2,690,278 A 9/1954 Flavius
4,057,176 A 11/1977 Horvath
4,685,594 A 8/1987 Czech
5,366,120 A 11/1994 Tollasepp
5,443,569 A * 8/1995 Uehira et al. ..... 222/190
5,570,819 A * 11/1996 Uehira et al. ..... 222/190
6,053,364 A * 4/2000 van der Heijden ..... 222/145.6
6,119,899 A * 9/2000 Iizuka et al. ..... 222/190
6,398,079 B1 * 6/2002 Garcia et al. ..... 222/190
2001/0054626 A1 12/2001 Bethone et al.

FOREIGN PATENT DOCUMENTS

FR 2564153 A 11/1985
WO WO 97/13585 A 4/1997
WO WO 99/54054 A 10/1999

* cited by examiner

*Primary Examiner*—Joseph A. Kaufman
(74) *Attorney, Agent, or Firm*—The Webb Law Firm

(57) ABSTRACT

A foam forming unit particularly suitable for a liquid container, comprising a pump for liquid and a pump for air, which are each provided with an inlet and an outlet, the foam forming unit further comprising a mixing chamber which is in communication with the outlet of each pump, a dispensing part provided with an outflow channel with a foam opening, the channel being in communication with the mixing chamber, and valves in respectively the inlet and the outlet of each pump for drawing in respectively delivering air and liquid, wherein one or more valves are formed integrally with the air pump or liquid pump into a single construction element.

21 Claims, 4 Drawing Sheets

FOAM FORMING UNIT

BACKGROUND OF THE INVENTION

1. Field of the Invention

This invention relates to a foam forming unit for use in combination with a liquid container, including a pump for air and a pump for liquid.

2. Brief Description of the Prior Art

Such a foam forming unit is, for example, known from international patent application WO 99/54054, which describes a foam spraying device for a liquid container, having an air suctioning part, a mixture chamber and a spray head with a foam outlet. A first piston-cylinder unit for air and a second piston-cylinder unit for liquid are provided between the spray head and the liquid container. Each unit is fitted with an inlet and an outlet valve. These units are coupled in such a way that they cooperate with each other.

In international patent application WO-A 97/13585 a foam dispensing device is described, which comprises a liquid container and operating unit of a concentric air pump and a liquid pump. Each pump has a piston chamber with a piston which is displaceable therein and an inlet and discharge. The operating component operates both pumps simultaneously. The air pump has a double-acting shut-off device which can be operated actively by the operating component and shuts off both the inlet and the discharge of air. It is mentioned in this document that normal valves, as passive shut-off devices which open by pressure differences generated in the unit, are not wanted and a shut-off device which can be operated actively by the operating component is a main characteristic of this foam forming unit. Moreover, although this foam forming unit can generate a good foam, i.e. a foam of correct texture, this known foam forming unit consists of a large number of construction components manufactured from different materials. The cost of manufacturing such a foam forming unit is therefore relatively high.

Further, in U.S. Pat. No. 4,057,176 a reciprocating type of finger pump for use on a liquid product container is described, which combines a tubular housing including a spray nozzle, mounted coaxially in the sleeve of an accumulator cap including a central valve. The valve opening leads to a dip tube which passes into the container. If the tubular housing is depressed, a hollow piston is driven against the tension of a spring. In order to provide an atomized spray two subsequent downward strokes are needed. This pump is only constructed to spray a liquid, although also other products like gases, vapors or powders can be atomized. However, it cannot provide a foam as in the present invention.

The object of the present invention is to improve the foam forming unit known from the prior art.

SUMMARY OF THE INVENTION

For this purpose the foam forming unit according to the invention includes a pump for air provided with an inlet having an inlet valve and an outlet having an outlet valve, a pump for liquid provided with an inlet having an inlet valve and an outlet having an outlet valve, a mixing chamber having at least one foam forming element and connected to the outlets of both pumps, and a dispensing part comprising an outflow channel, which is connected between the mixing chamber and a foam opening, wherein at least one of the outlet valves is provided as a thin membrane and integrally formed with a member of said pumps as one piece of the same, preferably plastic, material. By combining interrelated functional elements to a single, integrally formed piece the number of construction components can be reduced, which results in lower manufacturing costs.

It is specially advantageous to provide the thin membranes of the valves as a cylinder or as a disc, which can be flexed easily by pressure differences.

BRIEF DESCRIPTION OF THE DRAWINGS

The invention will now be further elucidated with reference to the annexed drawing presenting an example of the present invention. In the drawings.

The same reference numerals are used in each of the Figures for the same construction components.

DETAILED DESCRIPTION OF THE INVENTION

Figure 1:
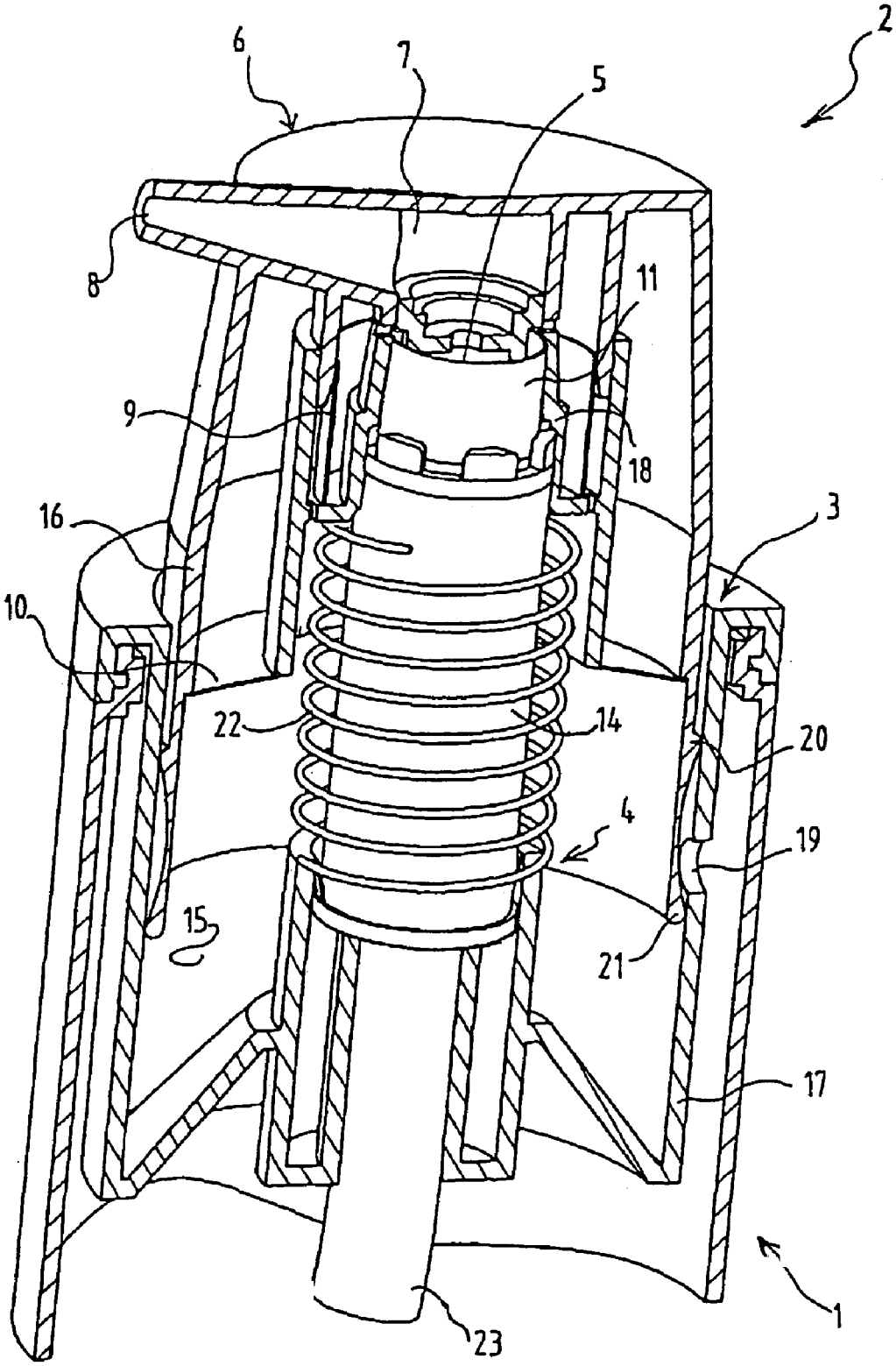
FIG. 1 shows a perspective, cross-sectional view of a foam dispensing assembly according to the invention.

In the perspective, cross-sectional view of FIG. 1 is shown a foam dispensing assembly consisting of a liquid container 1 and a foam forming unit 2. The foam forming unit 2 comprises a pump 3 for air and a pump 4 for liquid which are each provided with an inlet and an outlet. The inlet of air pump 3 is in communication with the environment, while the inlet of liquid pump 4 is in communication with the content of liquid container 1. Foam forming unit 2 further comprises a mixing chamber 5 which is in communication with the outlet of both air pump 3 and liquid pump 4.

On the top part of the assembly is situated a dispensing part 6 which is provided with an outflow channel 7 with a foam opening 8. Outflow channel 7 runs from mixing chamber 5 to foam opening 8. One or more foam forming elements are normally located in this channel 7.

Both the outlet and the inlet of each pump 3,4 are provided with a valve respectively 9,10,11,12 for delivering respectively drawing in air or liquid. Valve 12 in the inlet of liquid pump 4 is otherwise shown in FIGS. 2 and 3.

Liquid pump 4 comprises a pressure chamber 13 formed by a hollow cylindrical piston 14 which is displaceable relative to an inner part of a holder element 17, in which valve 12 is seated. It is otherwise noted that the term "piston" is understood to mean that part of the pump which is moved (compare FIG. 2 and FIG. 4). Pressure chamber 13 is thus located between inlet valve 12, outlet valve 11 and piston 14 of liquid pump 4. In addition, air pump 3 comprises a pressure chamber 15 formed by a hollow cylindrical piston 16 which is displaceable relative to an outer part of cylindrical holder element 17. Pressure chamber 15 of air pump 3 is bounded on one side by inlet valve 10 and outlet valve 9 and on the other side between pistons 14,16 of the two pumps 3,4 and holder element 17. These hollow cylindrical pistons are placed concentrically relative to each other.

An operating member 6 for operating the two pumps 3,4 is manufactured integrally with piston 16 of air pump 3. The operating member 6, or the piston 16 of air pump 3, is arranged slidably in holder element 17 which holds the foam forming unit 2 in liquid container 1. Upon displacement of operating member 6, this movement is transmitted directly onto piston 16 to operate air pump 3. When operating member 6 is displaced, the liquid pump 4 is also operated in that a coupling element 18 is arranged between operating member 6 and the piston 14 of liquid pump 4, which coupling element transmits the displacement of operating member 6 to piston 14 of liquid pump 4. Finally, it should be noted that dispensing part 6 is identical with the operating member.

FIG. 1 shows clearly that the valves 9,10,11 are formed by membranes of a predetermined thickness formed on construction elements 14. At a wall thickness of construction elements 14 and 18 of about 1 mm, the thickness of the cylindrical membranes 9 and 11 is for instance 0.2 mm. Valve 10 is formed as a disc membrane with the same thickness. Valves 9, 10,11 are injection moulded from plastic simultaneously with air pump 3 of liquid pump 4 to form a single construction element 14,18, i.e. as one piece of the same plastic material. For an understanding of the present invention it is noted that the coupling element 18 is deemed to be a part of air pump 3.

Figure 4:
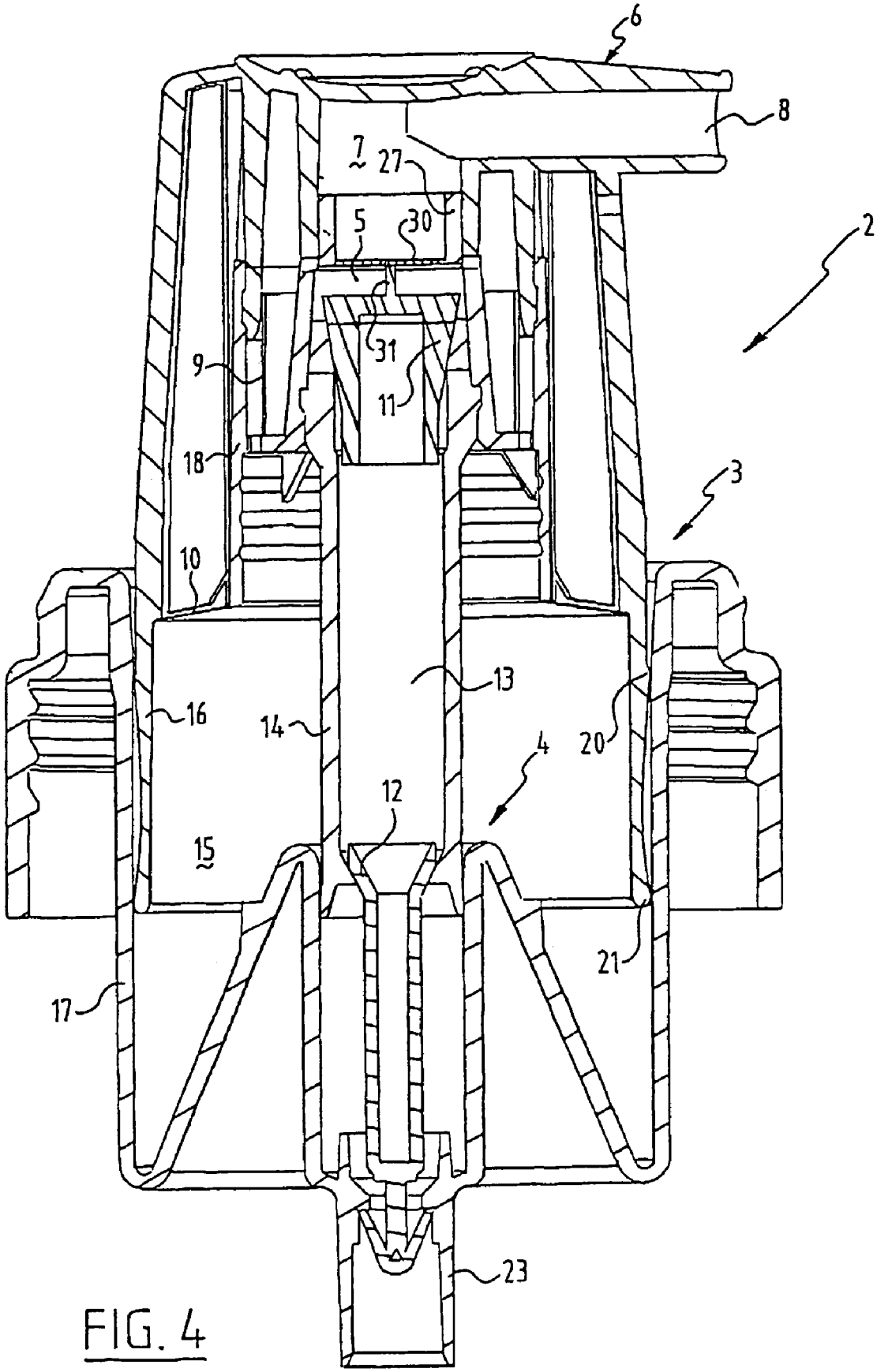
FIG. 4 shows a cross-section of another embodiment of a foam forming unit according to the invention.

Coupling element 18 has on the side directed toward dispensing part 6 an extension 27 with two circular seats 28, 29 of different diameter. In these seats are placed one or more foam forming elements, for instance in the form of fine-mesh screens (not shown). In the embodiment of FIG. 4 the foam forming element is likewise located in the extension 27 of coupling element 18, but is in this case formed by a wall with holes 30 which are co-moulded during the injection moulding of coupling element 18. For a good foaming action the holes have a diameter of a maximum of about 0.2 mm, the wall in which they lie is about 0.2 mm thick and the wall contains between 100 and 200 holes, preferably about 150 holes. These specifications can be employed in reasonably uniform manner in foam forming units for cosmetic products.

In the second embodiment of the foam forming unit 2 shown in FIG. 4, outlet valve 11 of liquid pump 4 is formed by a separate conical stopper which co-acts with the upper edge of piston 14. On the stopper 11 is a rod 31 which lies in contact against the wall with holes 30. Through dimensioning and material choice this foam forming element 30 has acquired a determined flexibility, so that under the influence of pressure built up in pressure chamber 13, transferred through stopper 11 and rod 31, it can deform. Foam forming element 30 therefore serves in the first instance together with rod 31 to close valve 11. When the pressure in chamber 13 becomes greater than the resistance of foam forming element 30, the valve will be opened.

An aerating hole 19 is further arranged in holder element 17 to replenish liquid container 1 with air from the environment when liquid is pumped out of the container for foam dispensing. In a non-pressurized extreme position (see FIG. 2) of the foam dispensing assembly the aerating hole 19 is situated between two sealing ribs 20,21 of air piston 16. These sealing ribs 20,21 ensure that in the position shown in FIG. 2 no liquid can exit to the outside when the assembly is held upside down relative to this position. In the second extreme position shown in FIG. 3, air from outside can flow into liquid container 1 to replenish container 1 with air.

Figure 2:
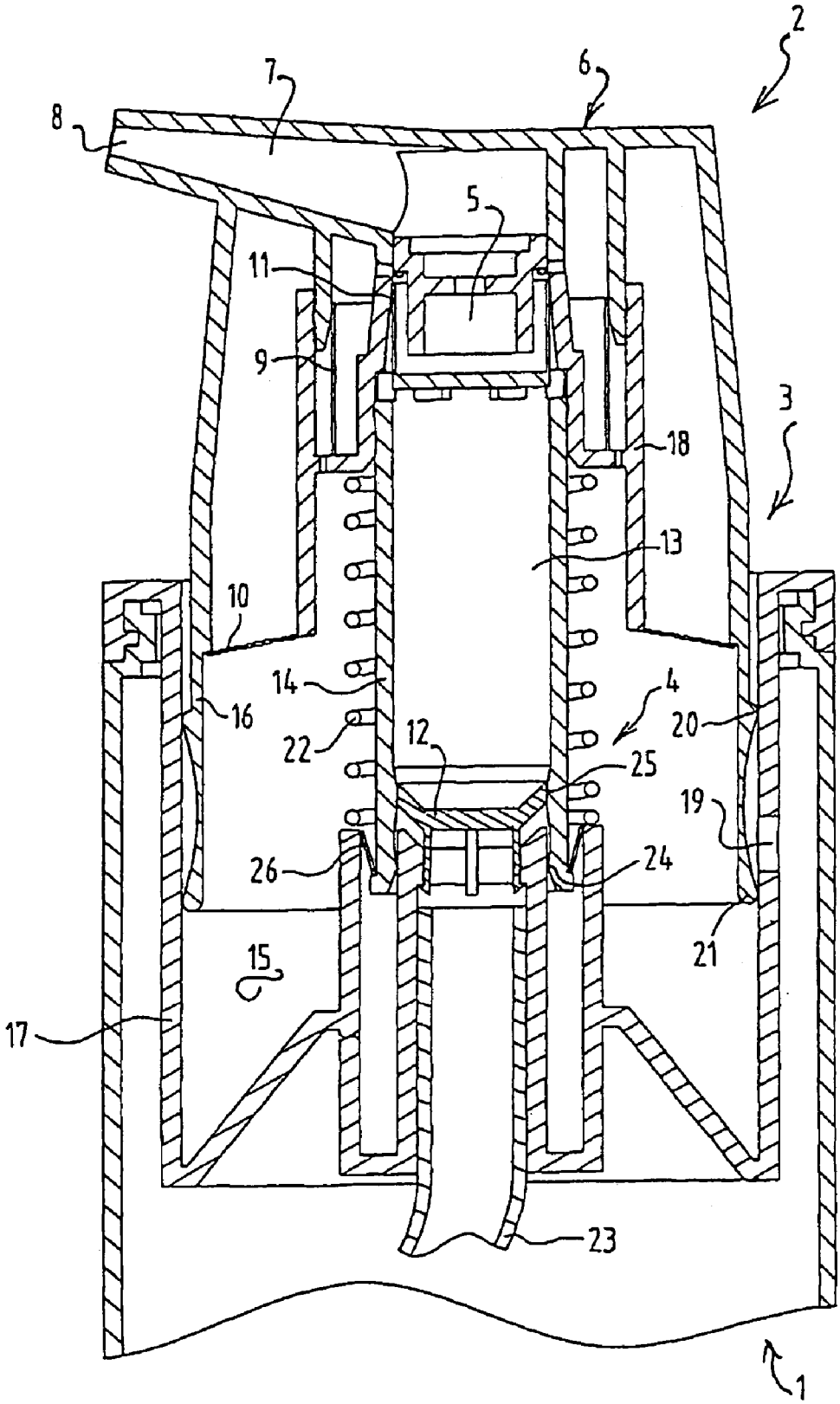
FIG. 2 shows a cross-section of the foam dispensing assembly of FIG. 1 in a first extreme position.
Figure 3:
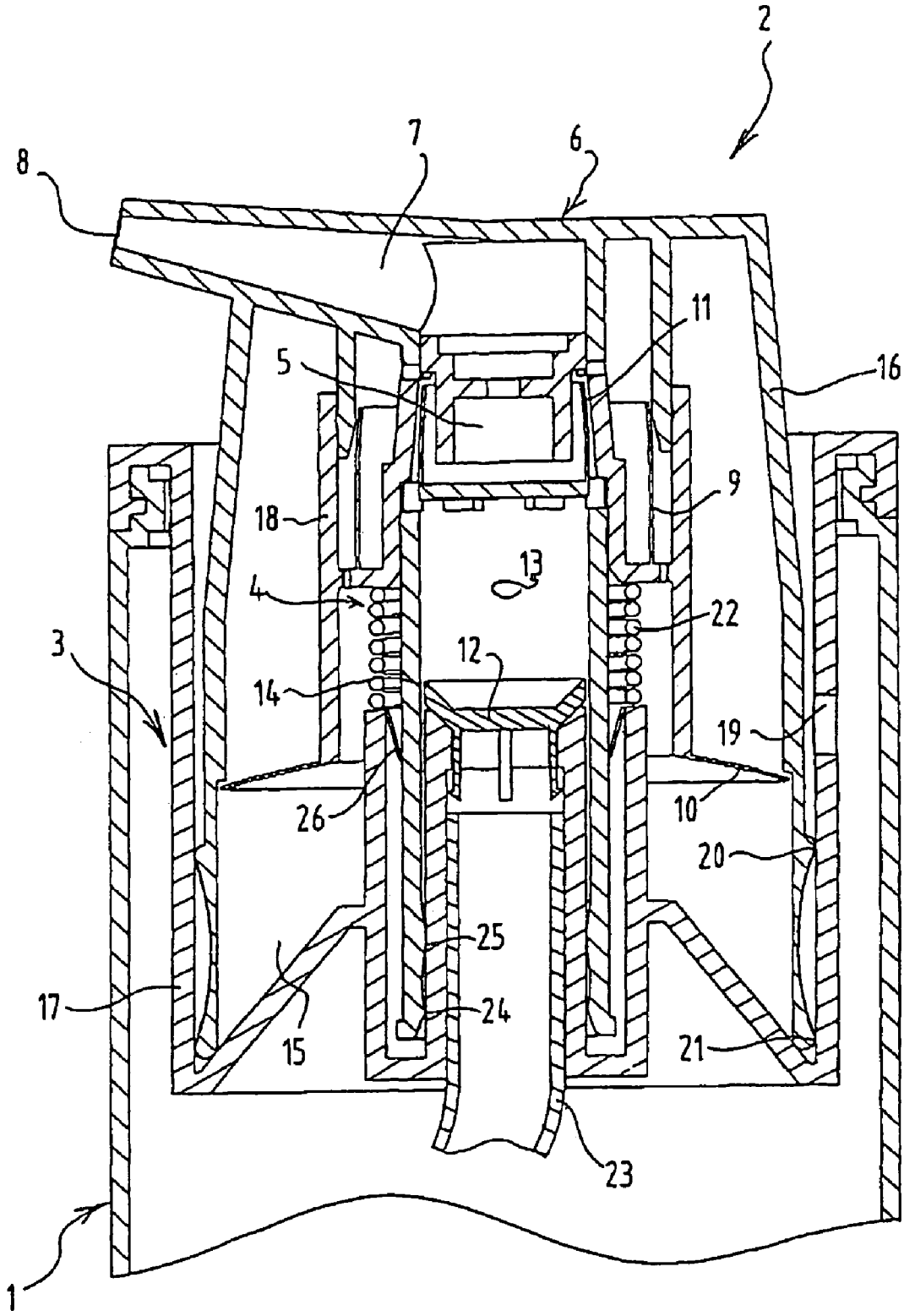
FIG. 3 shows a cross-section of the foam dispensing assembly of FIG. 1 in a second extreme position.

The positions shown in FIGS. 2 and 3 are two extreme positions of the assembly. Between these two positions is defined a stroke respectively in downward direction (from the position of FIG. 2 to the position of FIG. 3) and in upward direction (from the position of FIG. 3 to the position of FIG. 2). The upward stroke is the suction stroke, wherein air as well as liquid are drawn to the respective pressure chambers 13,15, while the downward stroke is the delivery stroke, wherein the air and the liquid are pressed out of pressure chambers 13,15 to mixing chamber 5.

The operation of the foam forming unit is described with reference to FIGS. 2 and 3, starting with FIG. 3. The operating member (air piston) 16, coupling element 18 and liquid piston 14 form a whole during operation of the foam dispensing assembly and are therefore designated below with the general term "piston". Arranged between piston 14,16,18 and holder element 17 is a spring 22 which is not loaded in the position shown in FIG. 2.

In FIG. 3 the piston 14,16,18 is in its compressed position and is on the point of being pressed upward by the spring force of spring 22. During the upward stroke the volume of pressure chamber 15 of air pump 3 becomes larger, whereby the pressure becomes lower than the ambient pressure. Owing to this pressure difference the inlet valve 10 of air pump 3 is opened and a connection is established between the environment and air pressure chamber 15. The same applies for the volume in pressure chamber 13 of liquid pump 4. Here too the volume is increased, whereby the pressure falls and liquid is drawn out of liquid container 1 via a rise tube 23. Suction of liquid via inlet valve 12 is possible because the liquid piston 14 with sealing ribs 24,25 arranged thereon is displaced downward and a passage is created between inlet valve 12 and piston 14 to pressure chamber 13.

The pump is now in its uppermost position (FIG. 2), wherein both the air pressure chamber 15 and the liquid pressure chamber 13 are filled with respectively air and liquid. When a downward force is now exerted on piston 14,16,18 which is greater than the spring force of spring 22 plus the friction forces between piston 14,16,18 and holder element 17, piston 14,16,18 will displace downward. The volume in air pressure chamber 15 is reduced and the pressure therefore increased, whereby inlet valve 10, which was opened in the upward stroke, is now pressed shut, while outlet valve 9 is opened. The same applies for the volume in liquid pressure chamber 13, wherein the inlet valve 12 is pressed into its seat by the pressure increase so as to close the inlet of liquid pump 4. In addition, outlet valve 11 of liquid pump 4 is opened by the increased pressure in liquid pressure chamber 13.

The air and the liquid come together in mixing chamber 5. Because the airflow and the liquid flow collide with each other the two are mixed well. After the mixture has been carried through one or more foam forming elements foam is created which via outflow channel 7 leaves the foam opening a of the dispensing part 6 of the assembly. The resistance of the membrane 11 in the embodiment shown in FIGS. 1–3 and of the wall with holes as foam forming element 30 in the embodiment of FIG. 4 ensures that liquid does not flow freely out of liquid pump 4. The flow of liquid in mixing chamber 5 is hereby controlled and manageable. Tests have shown that this is essential to obtaining a good foam.

Because inlet valve 12 is provided with a stopper body which co-acts with the sealing ribs 24,25 arranged in piston 14, a liquid lock is further created. This means that in the rest position (FIG. 2) it is ensured that no liquid exits the assembly or comes to lie between piston 14,16,18 and holder element 17 when the pressure in container increases, for instance because the container is squeezed. When the pressure in liquid container 1 increases, stopper body 12 will be pressed against sealing rib 25 and thereby obstruct the passage for liquid to either of the pressure chambers 13,15.

Holder element 17 is provided with a number of peripheral segments, designated with reference numeral 26, for the purpose of limiting the stroke of piston 14,16,18 relative to pressure chambers 13,15. These peripheral segments lie in the first instance in the line of the cylindrical bottom wall of holder element 17, i.e. are injection moulded in this position together with holder element 17, and are bent during assembly of the foam dispensing assembly. During assembly the holder element 17 is snapped or screwed onto liquid container 1, whereafter piston 14,16,18 is placed on holder element 17 and the peripheral segments 26 are bent inward.

The present invention is of course not limited to the preferred embodiments shown in the drawings. Although the pumps 3,4 are shown as concentric, it is also possible to provide them eccentrically or adjacently of each other. An example of such a construction is to be found in the international patent application WO 99/54054. It is further also possible for instance to embody the inlet valve 12 for liquid pump 4 as a membrane formed on piston 14 or holder element 18, wherein a liquid lock will have to be provided in another manner. In any case there is provided according to the invention a simplified foam forming unit with a relatively small number of construction components.

The invention claimed is:

1. A foam forming unit for use in combination with a liquid container, comprising:

a pump for air provided with an inlet having an inlet valve, an outlet having an outlet valve and a pressure chamber with a movable member for increasing or reducing the volume of the pressure chamber, a pump for liquid provided with an inlet having an inlet valve, an outlet having an outlet valve and a pressure chamber with a movable member for increasing or reducing the volume of the pressure chamber, a mixing chamber having at least one foam forming element and connected to the outlets of both pumps, and a dispensing part comprising an outflow channel, which is connected between the mixing chamber and a foam opening, wherein the movable members of the pumps are interconnected and operated by a common operating member, an independent mechanical coupling element interconnects the movable member of the air pump and the movable member of the liquid pump and is formed separately from the movable member of the air pump and the movable member of the liquid pump, and at least one of the outlet valves is provided as a thin membrane and integrally formed with a member of said pumps as one piece of the same plastic material.

2. The foam forming unit according to claim 1, wherein the outlet valve of the pump for air is formed as a cylindrical membrane.

3. The foam forming unit according to claim 2, wherein the inlet valve of the air pump is provided as a disc membrane and integrally formed with a member of the air pump as one piece of the same material.

4. The foam forming unit according to claim 1, wherein the foam forming element is integrally formed with the mixing chamber as one piece of the same material as a fine-mesh screen having a plurality of holes.

5. The foam forming unit according to claim 1, wherein the inlet valve of the liquid pump is formed by a conical stopper body co-acting with the inlet opening of the liquid pump.

6. The foam forming unit according to claim 5, wherein the inlet opening of the liquid pump is provided with pairs of cylindrical sealing ribs.

7. The foam forming unit according to claim 1, wherein the outlet valve of the liquid pump is integrally formed with the movable member of the liquid pump as one piece of the same material.

8. The foam forming unit according to claim 1, wherein each movable member is a piston of open cylindrical form, which is movable relative to a cylindrical holder element.

9. The foam forming unit according to claim 1, wherein the operating member and the movable member of the air pump are integrally formed as one piece of the same material.

10. The foam forming unit according to claim 1, wherein the mechanical coupling element and the mixing chamber are integrally formed as one piece of the same material.

11. The foam forming unit according to claim 1, wherein the inlet valve and the outlet valve of the air pump are integrally formed with the coupling element as one piece of the same material.

12. The foam forming unit according to claim 1, further including a peripheral segment which limits the upward stroke of the movable members of both pumps.

13. The foam forming unit according to claim 1, wherein the outlet valve of the pump for liquid is formed as a cylindrical membrane.

14. A foam forming unit for use in combination with a liquid container, comprising:

a pump for air provided with an inlet having an inlet valve and an outlet having an outlet valve, a pump for liquid provided with an inlet having an inlet valve and an outlet having an outlet valve, wherein the pump for air and the pump for liquid each comprise a pressure chamber with a displaceable piston for increasing or reducing the volume of the pressure chamber, a mixing chamber having at least one foam forming element and connected to the outlets of both pumps, and a dispensing part comprising an outflow channel, which is connected between the mixing chamber and a foam opening, wherein the displaceable pistons of the pumps are interconnected and operated by an operating member, an independent mechanical coupling element interconnects the piston of the pump for air and the piston of the pump for liquid and is formed separately from the piston of the pump for air and the piston of the pump for liquid, and at least the outlet valve of the pump for air is provided as a membrane and integrally formed with the coupling element to form a single construction element.

15. The foam forming unit according to claim 14, wherein the outlet valve of the pump for liquid is integrally formed with the piston of the pump for liquid to form a single construction element.

16. The foam forming unit according to claim 14, wherein the outlet valve of the pump for air and the outlet valve of the pump for liquid are formed as cylindrical membranes.

17. The foam forming unit according to claim 14, wherein the inlet valve of the pump for air is provided as a membrane and integrally formed with the coupling element.

18. The foam forming unit according to claim 14, wherein the foam forming element and the mixing chamber are integrally formed with the coupling element.

19. The foam forming unit according to claim 14, wherein the inlet valve of the pump for liquid is formed by a conical stopper body coacting with the inlet opening of the pump for liquid.

20. The foam forming unit according to claim 14, wherein the operating member and the piston of the pump for air are integrally formed to one piece.

21. The foam forming unit according to claim 14, wherein the inlet valve and the outlet valve of the pump for air are integrally formed with the coupling element to form a single construction element.

* * * * *